US005163848A

United States Patent [19]

Maeda et al.

[11] Patent Number: 5,163,848

[45] Date of Patent: Nov. 17, 1992

[54] INCOMPLETE FITTING PREVENTION CONNECTOR

[75] Inventors: Akira Maeda; Naoto Taguchi; Kiyohito Fukuda, all of Shizuoka, Japan

[73] Assignee: Yazaki Corporation, Tokyo, Japan

[21] Appl. No.: 765,080

[22] Filed: Sep. 24, 1991

[30] Foreign Application Priority Data

Sep. 27, 1990 [JP] Japan ..... 2-100132[U]
Oct. 11, 1990 [JP] Japan ..... 2-270459
Nov. 29, 1990 [JP] Japan ..... 2-125260[U]

[51] Int. Cl.[5] ..... H01R 3/00
[52] U.S. Cl. ..... 439/489; 439/354
[58] Field of Search ..... 439/347, 352, 354, 488, 439/489, 595

[56] References Cited

U.S. PATENT DOCUMENTS 4,496,213 1/1985 Borsuk ..... 439/489 X
4,867,699 9/1989 Oda et al. ..... 439/489 X
4,915,648 4/1990 Takase et al. ..... 439/489 X
4,993,967 2/1991 Matsumoto ..... 439/489

FOREIGN PATENT DOCUMENTS 57-49913 11/1982 Japan .
59-29351 8/1984 Japan .

*Primary Examiner*—Neil Abrams
*Assistant Examiner*—Khiem Nguyen
*Attorney, Agent, or Firm*—Sughrue, Mion, Zinn, Macpeak & Seas

[57] ABSTRACT

In an incomplete fitting prevention connector, when female and male housings are completely fitted together, a lock arm provided on one of housings is engaged in a retaining hole provided in the other. A fitting confirmation member is beforehand retained in the retaining hole, and since the lock arm enters the retaining hole, at least part of the fitting confirmation member is projected outwardly from the retaining hole. Therefore, the complete fitting can be confirmed from the exterior. After this confirmation, the fitting confirmation member can be removed.

20 Claims, 9 Drawing Sheets

INCOMPLETE FITTING PREVENTION CONNECTOR

BACKGROUND OF THE INVENTION

This invention relates generally to a connector used for connecting wire harnesses of an automobile, and more particularly to a device for preventing an incomplete locking connection between a pair of connectors.

Generally, a connector comprises female and male connector housings, and by fittingly connecting them together, metal terminals provided therein are electrically connected together. In order to prevent the connected condition from being loosened by vibrations and so on when the connector is used in an automobile or the like, a lock arm is provided on one of the female and male connector housings, and an engaging hole is provided in the other, and they are engaged with each other to achieve the locking.

FIG. 1 shows such connector. In FIG. 1, reference character a denotes a male connector housing, and reference character b denotes a male connector housing. A flexible lock arm c of the cantilever type is formed on an upper surface of the male connector housing, and extends rearwardly. The female connector housing b has an engaging hole d for receiving a retaining portion cl of the flexible lock arm c.

In the above construction, when the male and female connector housings a and b are to be connected together, the retaining portion c1 is abutted against a front end of an engaging frame portion d1 of the female connector housing b, so that the flexible lock arm c is displaced downward (FIG. 2A), and then the flexible lock arm c is restored to its initial condition upon reception of the retaining portion c1 in the engaging hole d, thereby achieving a completely-connected condition (FIG. 2B) in which the locking connection is completed.

In the above locking connection between the male and female connector housings a and b, the flexible lock arm c in a displaced condition is strongly pressed against the engaging frame portion d1, and therefore the incompletely-connected condition (FIG. 2A) is often mistaken for the completely-connected condition. Moreover, if an electrical contact between metal terminals is made, the incompletely-connected condition can not be found even at an inspection step, and the product would be sent to the market. In such case, the connected condition would be loosened by vibrations and so on, and the electrical connection between the terminals would also be released later.

To overcome such difficulty, Japanese Utility Model Examined Publication No. Sho. 59-29351 proposes a lock mechanism shown in FIG. 3.

In FIG. 3, reference character M denotes a male housing, and reference character F denotes its mating housing, that is, a female housing. A lock arm G is formed on an upper wall e of the male housing M through an upstanding proximal portion f, and extends toward the mating female housing F. The lock arm g is flexible, and is resiliently displaceable upward and downward about the proximal portion f serving as a fulcrum. The lock arm g has a lock pawl h at its distal end. Reference character i denotes a receiving chamber for receiving a metal terminal (not shown).

The front half portion of the female housing F defines a sleeve portion J for receiving the male housing M, and a fitting chamber k for allowing the insertion of the lock arm g thereinto is provided in continuous relation to the sleeve portion j. A retaining hole 1 is formed through the upper wall of this fitting chamber. Although not shown, metal terminal receiving chambers corresponding to the receiving chambers i are provided in the rear half portion of the female housing F.

A lock release prevention piece m is inserted between the lock arm g in its locked condition and the upper wall e of the housing so as to provide confirmation of the completely fitting between the female and male housings F and M and also to prevent the release of the locking.

In the above construction, the female and male housings F and M are fitted relative to each other, and the lock pawl h is introduced into the fitting chamber k. When the fitting further proceeds, in the completely fitted position, the lock arm g is resiliently restored, and the lock pawl h on the upper surface thereof at the distal end thereof is engaged in the retaining hole 1, so that the female and male housings F and M are locked together completely.

Thereafter, the lock release prevention piece m is introduced between the proximal portion f of the lock arm g and an inlet surface k1 of the fitting chamber k from the side, and if this is done, the complete fitting is confirmed. Namely, if the female and male housings F and M are not completely fitted relative to each other, the lock release prevention piece m can not be attached, and therefore an incomplete fitting can be prevented.

In the above construction, however, in order to prevent the incomplete fitting between the female and male housings F and M, there are required two operations, that is, the direct fitting of the male housing M into the female housing F and the attachment of the lock release prevention piece m. And besides, even if the attachment of the lock release prevention piece m is forgotten, the electrical conduction is obtained as described above, and therefore there is a possibility that the check with the incomplete fitting is inadvertently forgotten. Moreover, since the lock release prevention piece m need to remain attached, the additional part is needed, and other problems are also encountered.

SUMMARY OF THE INVENTION

This invention seeks to overcome the above problems. Accordingly, it is an object of the invention to provide a connector which enables an incomplete fitting to be checked positively, and does not need an additional part.

Another object of the present invention is to provide a connector with a construction by which a complete connection of a connector can be easily detected.

The above object has been achieved by a half-fitting prevention connector wherein a resiliently-displaceable lock arm is provided on one of a pair of female and male housings to be opposed to each other to be fitted together, and a retaining hole for engagement with said lock arm is provided in the other housing; CHARACTERIZED in that:

a fitting confirmation member is provided in said retaining hole; and when said lock arm is engaged with said fitting confirmation member, at least part of said fitting confirmation member is projected from said retaining hole.

Preferably, the fitting confirmation member is made of a flexible material, and has a push portion for abutting against the one housing before a complete fitting, and upon complete fitting between the female and male housings, the fitting confirmation member is flexed to release the retaining of the fitting confirmation member relative to the retaining hole, so that at least part of the fitting confirmation member is sprung out from the retaining hole by a repulsive force resulting from the release of the flexing.

Preferably, upon complete fitting between the female and male housings, the fitting confirmation member is rendered removable.

When the female and male housings are completely fitted together, the lock arm provided on the one housing is engaged in the retaining hole provided in the other housing. The fitting confirmation member is beforehand retained in the retaining hole, and since the look arm enters the retaining hole, at least part of the fitting confirmation member is projected outwardly from the retaining hole. Therefore, the complete fitting can be confirmed from the exterior. After this confirmation, the fitting confirmation member can be removed.

The fitting confirmation member may be made of a flexible material. When the female and male housings are to be fitted together, the one housing is abutted against the push portion of the fitting confirmation member, and the complete fitting is achieved while flexing the fitting confirmation member. Then, in the completely fitted position, the retaining of the fitting confirmation member is released, and at least part of the fitting confirmation member is sprung out exteriorly of the housing by the repulsive force resulting from the release of the flexing. After confirming the fitting, the fitting confirmation member can be removed.

Further, the above object has been achieved by a device for detecting a locking connection of a connector comprising a connector housing having a flexible lock arm; another connector housing having an engaging portion for engagement with said flexible lock arm; and a locking connection detection piece retained on one of said pair of connector housings by a flexible retaining piece; when said pair of connector housings are completely connected together, the other of said pair of connector housings driving said flexible retaining piece to release the retaining of said locking connection detection piece by said flexible retaining piece to thereby enable the removal of said locking connection detection piece.

Furthermore, in order to achieve the above-noted and other objects, the present invention provides an incomplete fitting prevention connector, comprising: a pair of first and second connector housings to be connected to each other; first means for locking the connection between the connector housings; and second means for notifying the locking by the first means, including a lock confirmation member, engagement means for engaging the lock confirmation member with the first connector to retain the lock confirmation member on the first connector housing, and releasing means for releasing the engagement between the lock confirmation member and the first connector housing when the connection between the connector housings is locked by the first means, to thereby enable the removal of the lock confirmation member to notify the locking by the first means.

BRIEF DESCRIPTION OF THE DRAWINGS

In the accompanying drawings:

FIG. 5A is a vertical cross-sectional view showing a condition during the fitted operation, and FIG. 5B is a vertical cross-sectional view showing a condition of completion of the fitting;

DETAILED DESCRIPTION OF THE PREFERRED EMBODIMENTS

Preferred embodiments of the present invention will now be described in detail with reference to the drawings attached hereto.

Figure 1:
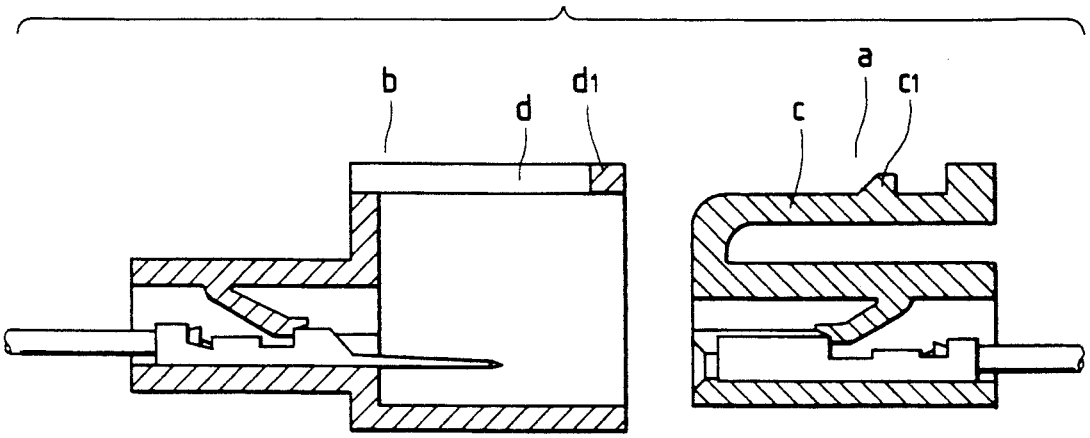
FIG. 1 is a cross-sectional view showing a conventional connector.
Figure 2A:
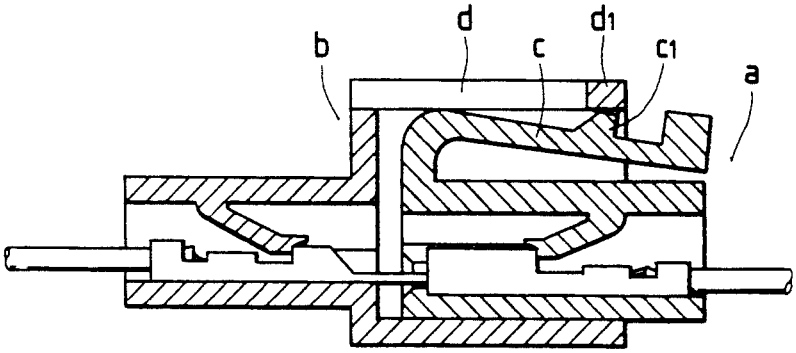
FIGS. 2A and 2B are cross-sectional views showing the process of connection in the conventional connector shown in FIG. 1.
Figure 2B:
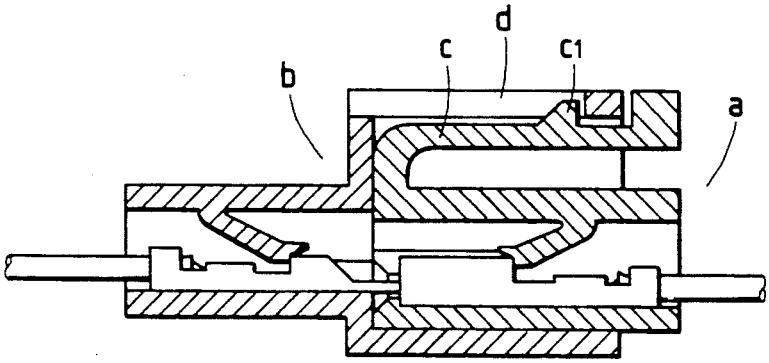
Figure 3:
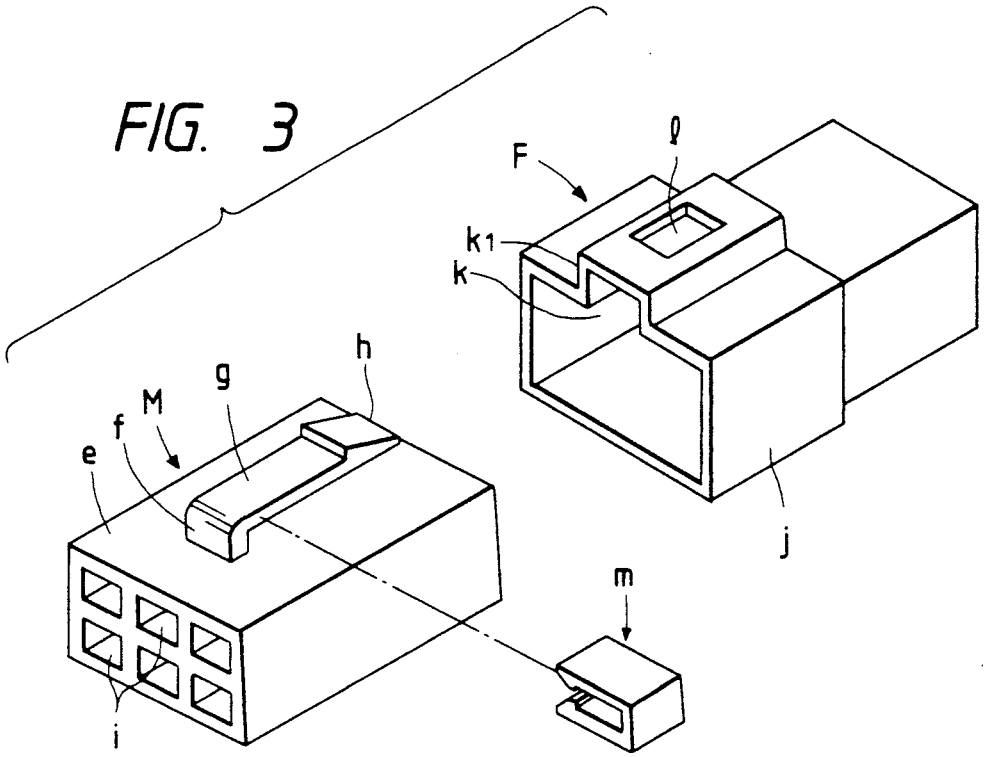
FIG. 3 is an exploded, perspective view showing a conventional incomplete fitting prevention connector.
Figure 4:
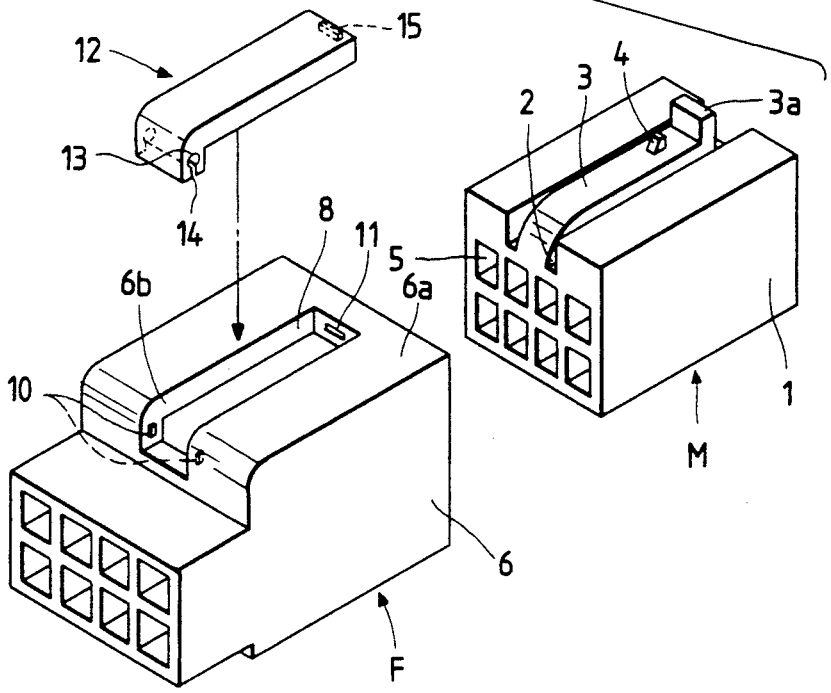
FIG. 4 is an exploded, perspective view showing an incomplete fitting prevention connector according to a first embodiment of the present invention.
Figure 5A:
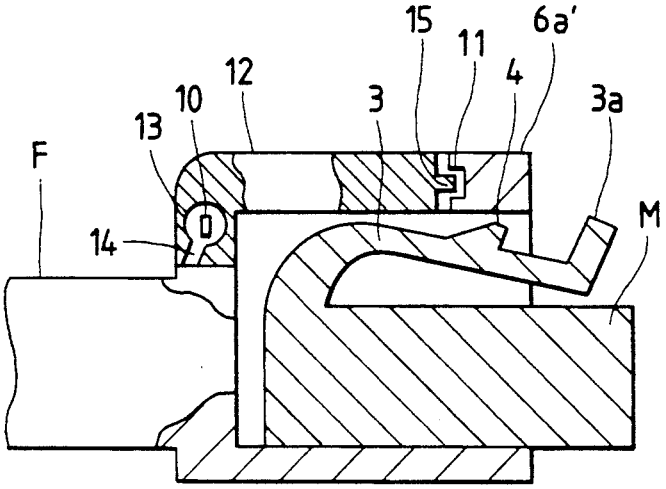
FIGS. 5A and 5B show a fitted condition of the connector shown in FIG. 4, where
Figure 5B:
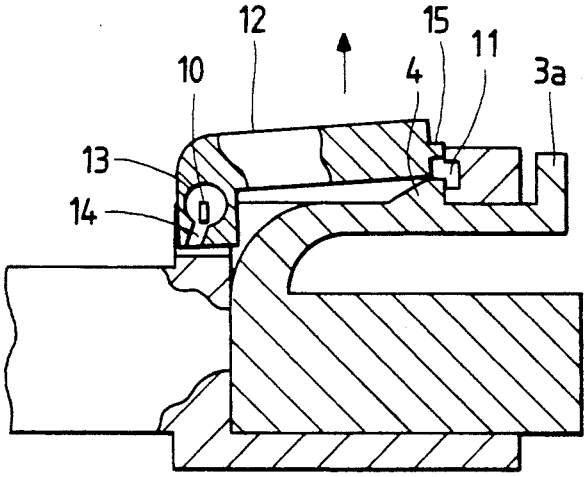

FIGS. 4, 5A and 5B show an incomplete fitting prevention connector according to a first embodiment of the present invention. In FIGS. 4 and 5, a male housing M is generally similar in construction to that of the conventional connectors shown FIGS. 1 to 3, and has a lock arm 3 having a fulcrum portion 2 at its proximal portion. An operating portion 3*a* bent into an L-shape is formed on the distal end of the lock arm 3, and a lock pawl 4 is formed on the lock arm 3 intermediate the opposite ends thereof, the lock pawl 4 having a slanting guide surface directed toward the fulcrum portion 2.

As in the conventional connectors, a female housing F has a sleeve portion 6 for receiving the male housing M which sleeve portion is defined by a front half portion of the female housing. A retaining hole 8 is formed through an upper wall 6*a* of the female housing. Projections 10 and 10, which are elongated in an upward-downward direction in the drawings, are formed respectively on opposed upstanding portions of an inner peripheral surface 6*b* of the retaining hole 8. A retaining portion 11 in the form of a hole is formed in that portion of the inner peripheral surface 6*b* close to the male housing M.

A fitting confirmation member 12 is retainably provided in the retaining hole 8, and has an L-shape as viewed from the side thereof, like the inner peripheral surface 6*b*. Circular hinge holes 13 are formed respectively in the opposite sides of the shorter leg of the L-shaped member 12. The projections 10 are fitted respectively in the hinge holes 13 for allowing a pivotal movement of the member 12, and therefore the diameter of the hinge hole 13 is slightly greater than the length of the projection 10. Further, a guide groove 14 is obliquely formed to extend to the hinge hole 13 so as to guide the projection 10 into the hinge hole 13. The width of the guide groove 14 is smaller than the length of the projection 10. A retaining portion 15 in the form of a projection is formed on the distal end of the longer leg of the L-shaped member 12, and is engageable in the retaining portion 11 of the housing. As shown in FIG. 5A, the fitting confirmation member 12 of the above construction is retained in the retaining hole 8 before the female and male housings F and M are fitted together.

When the female and male housings F and M are to be fitted together, first, as shown in FIG. 5A, the lock pawl 4 is abutted against an outer wall portion 6*a*' disposed forwardly of the retaining hole 8, so that the lock arm 3 is flexed and passes below the outer wall portion 6*a*'. Then, in the completely fitted position as shown in FIG. 5B, the lock arm 3 is resiliently restored, so that the lock pawl 4 on the upper surface thereof is engaged in the locking hole 8, thereby locking the female and male housings F and M together. At the same time, as shown in FIG. 5B, the right end of the fitting confirmation member 12 is urged upward by the lock pawl 4, so that the retaining portion 15 is disengaged from the retaining portion 11 of the retaining hole 18, and as a result the fitting confirmation member 12 is projected outwardly. Therefore, the operator can easily confirm the complete fitting. When part of the fitting confirmation member 12 is thus projected outwardly from the female housing F, the guide groove 14 is disposed parallel to the projection 10, and therefore the fitting confirmation member 12 can be easily removed by pulling it up in a direction of an arrow.

Figure 6A:
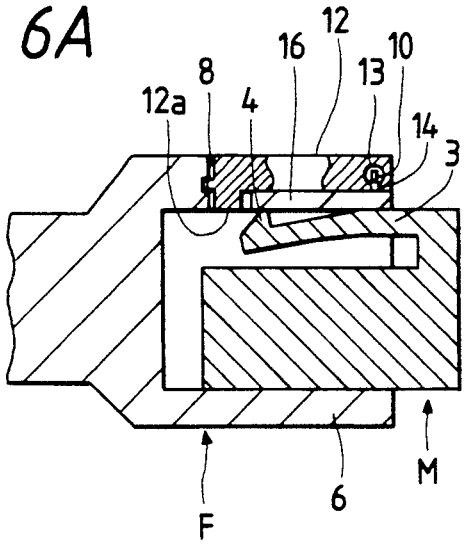
FIGS. 6A, 6B and 6C are vertical cross-sectional views of a modified one of the connector according to the first embodiment of the present invention, respectively showing a condition during the fitting operation, a completely fitted condition, and a condition in which a fitting confirmation member is removed after confirming the complete fitting.
Figure 6B:
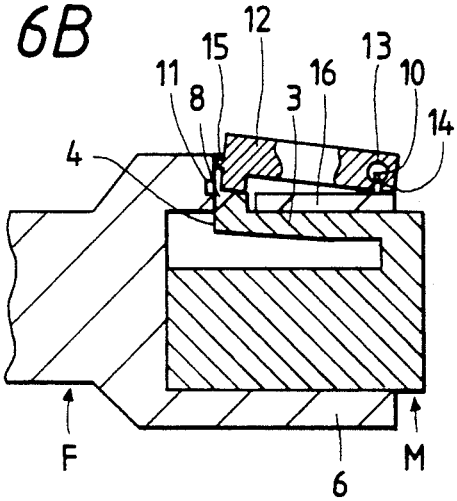
Figure 6C:
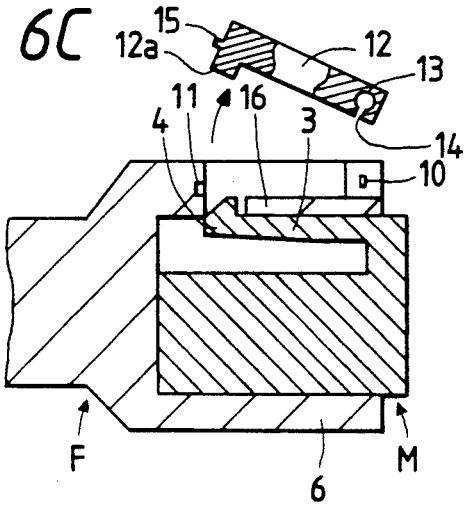

FIGS. 6A, 6B and 6C show a modified one of the incomplete locking prevention connector according to the first embodiment of the present invention in which a lock arm 3 is provided in a direction reverse to the direction of provision of the lock arm in the connector shown in FIG. 4. In this connector, a lock pawl 4 is formed on the distal end of the lock arm 3, and the operation portion 3*a* is not provided. Hinge holes 13 and guide holes 14 in a fitting confirmation member 12 are provided close to the front end of the housing. An engaging piece 16 for engagement with the lock pawl 4 extends from the front end portion of the female housing F into a retaining hole 8. Projections 10 are fitted respectively in the hinge holes 13 formed in the right end (FIGS. 6A, 6B and 6C) of the fitting confirmation member 12, and the fitting confirmation member 12 is placed on the engaging piece 16 so as to be pivotally moved about the projections 10, and a distal end surface 12*a* of the fitting confirmation member 12 is disposed adjacent to the distal end of the engaging piece 16, and is directed toward the interior of a sleeve portion 6. As in the preceding connector, a retaining portion 15 is formed on the left end of the fitting confirmation member 12, and is engaged in a hole-like retaining portion 11 formed in the peripheral edge of the retaining hole 8.

When the female and male housings F and M are to be fitted together, the lock arm 3 is flexed downward and is introduced into the sleeve portion 6 by urging the two housings in the fitting direction. During the fitting operation, the lock pawl 4 on the distal end of the lock arm 3 is held by the engaging piece 16, and moves along the lower surface thereof, as shown in FIG. 6A.

When the female and male housings F and M are completely fitted together, the lock arm 3 is restored to its initial condition, and the lock pawl 4 is engaged with the distal end of the engaging piece 16 in the retaining hole 8 to provide a lock condition, as shown in FIG. 6B. The upper end of the lock pawl 4 is abutted against the lower end surface 12*a* of the fitting confirmation member 12, and the engagement between the retaining portions 11 and 15 is released by the restoring force of the lock arm 3, so that the lower end surface 12*a* is raised. As a result, part of the fitting confirmation member 12 is projected outwardly from the female housing F, thereby telling that the complete fitting has been made. At this time, each guide groove 14 is disposed in alignment with the corresponding projection 10, and the fitting confirmation member 12 can be removed by pulling it upward in a direction of an arrow in FIG. 6C.

Figure 7:
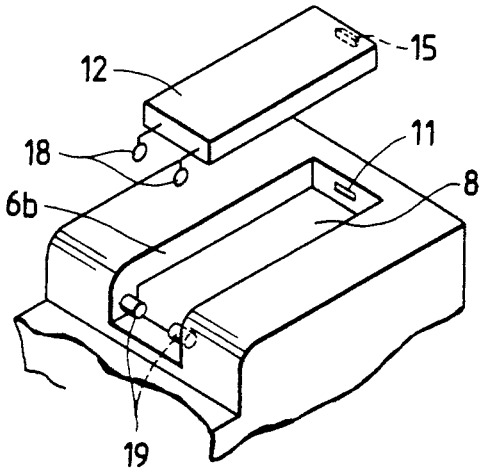
FIGS. 7 and 8 are perspective views of important portions of modified retaining constructions for retaining a fitting confirmation member relative to a retaining hole, respectively.
Figure 8:
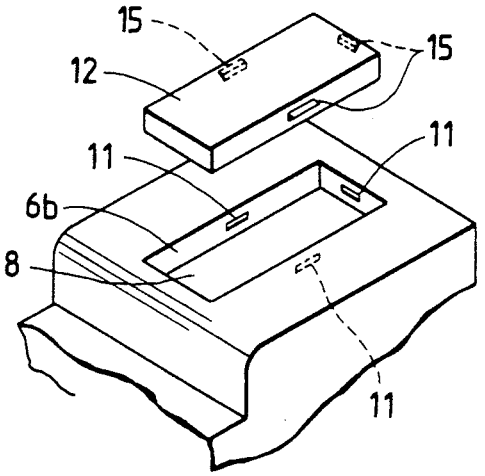
Figure 9:
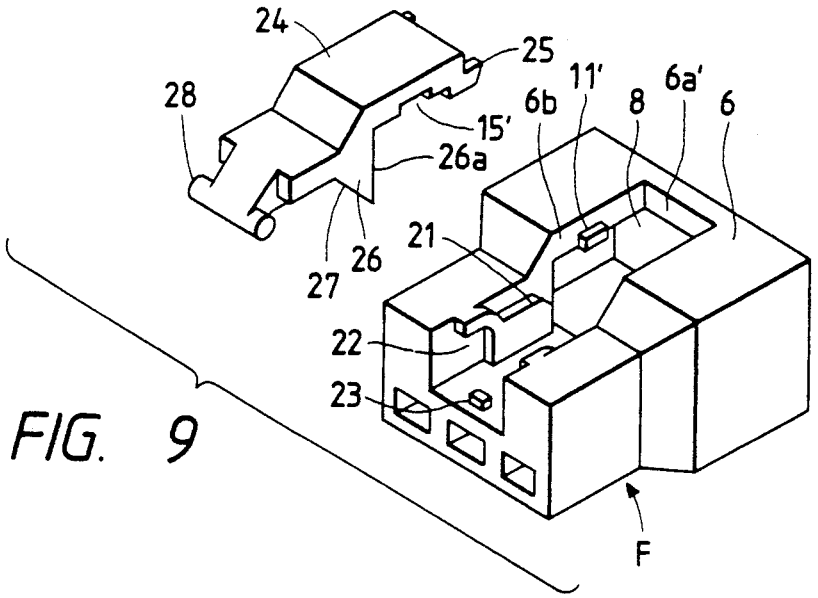
FIG. 9 is a perspective view showing another modified one of the connector according to the first embodiment of the present invention.

FIGS. 7 and 8 show modified retaining constructions for retaining a fitting confirmation member 12 relative to a retaining hole 8.

In FIG. 7, two flexible wires extends from the fitting confirmation member 12, and the distal end portion of each of these wires is formed into a circular loop to provide a retaining portion 18. Pivot pins 19 for fitting respectively in the retaining portions 18 are formed respectively on opposed portions of a peripheral surface 6*b* of the retaining hole 8.

In FIG. 8, retaining projections 15 are formed respectively on three sides of the fitting confirmation member 12, and retaining recesses 11 corresponding respectively to the retaining projections 15 are formed in a peripheral surface 6*b* of the retaining hole 8.

In this connector, when the lock pawl 4 enters the retaining hole 8, the engagement of the fitting confirmation member 12 is automatically released, so that it is removed from the retaining hole 8. Therefore, no manual removal is needed.

FIGS. 9, 10A, 10B and 10C show another modified one of the connector according to the first embodiment of the present invention. A male housing M in these Figures is the same as that in the embodiment of FIG. 4. With respect to a female housing F, a retaining hole 8 not only is formed in a sleeve portion 6, but also extends in a grooved manner up to the left end of the housing. Projection-like retaining portions 11' are formed respectively on opposite sides of a peripheral surface 6*b* of the retaining hole 8, and guide projections 21 each having a rounded front end are formed respectively on the opposite sides of the peripheral surface 6*b* intermediate the opposite ends of the retaining hole 8, and shaft receiving recesses 22 are provided respectively at the opposite sides of the peripheral surface 6*b* rearwardly adjacent to the respective guide projections 21, and further a shaft retaining portion 23 is formed on a central portion of the rear end of the peripheral surface 6*b*.

A fitting confirmation member 24 is generally elongated, and projections 25 for engagement with a peripheral wall 6*a*' of the retaining hole 8 are formed respectively on the opposite side portions of the longitudinal front end of the fitting confirmation member 24. Retaining portions or recesses 15' for receiving the respective retaining portions 11' are formed respectively in the opposite sides of the fitting confirmation member 24, and are disposed slightly rearwardly of the projections 25. Disposed rearwardly of the retaining portions 15' is a projection-like push portion 26 of a triangular cross-section which is adapted to be projected into the interior of the sleeve portion 6. The push portion 26 has a generally vertical front surface 26*a*, and an inclined rear surface 27 for abutment against the guide projections 21. A shaft 28 is formed at the rear end of the fitting confirmation member 24, and extends perpendicularly to the longitudinal axis thereof.

Figure 10A:
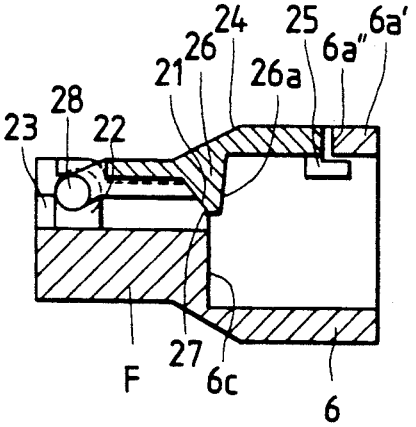
FIGS. 10A, 10B and 10C are cross sectional views of the connector shown in FIG. 9, respectively showing a condition before the fitting, a condition during the fitting, and a condition in which a fitting confirmation member is sprung out after the fitting is finished.

As shown in FIG. 10A, the fitting confirmation member 24 is attached to the female housing F. More specifically, first, the fitting confirmation member 24 is vertically oriented with the projections 25 directed upward and with the shaft 28 directed downward, and then the shaft 28 is introduced between the shaft receiving recesses 22 and the shaft retaining portion 23 (see FIG. 10C). Then, the front end of the fitting confirmation member is urged in a clockwise direction to thereby engage the projections 25 with a distal end portion 6*a*'' of the peripheral wall 6*a*', thus completing the attachment.

In this condition, the shaft 28 is prevented by the shaft receiving recesses 22 from rightward and upward movements, and is also prevented by the shaft retaining portion 23 from leftward withdrawal. Therefore, the fitting confirmation member 24 can not be removed from the female housing F. The vertical front surface 26*a* of the push portion 26 is slightly projected forwardly beyond a rear surface 6*c* of the sleeve portion, and the inclined rear surface 27 of the push portion 26 is held against the guide projections 21.

Figure 10B:
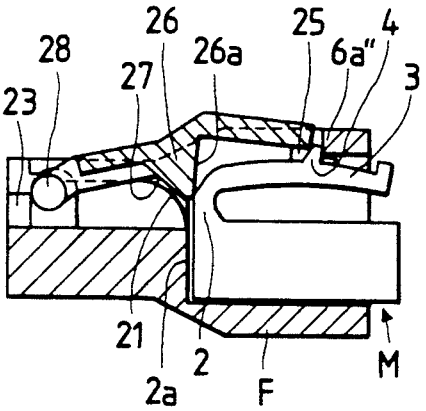

When the male housing M is inserted into the sleeve portion 6 of the female housing F with the lock arm 3 being flexed, a front end surface 2*a* of the male housing is abutted against the vertical surface 26*a* of the push portion 26. When the male housing is further inserted, the inclined surface 27 moves upward along the guide projections 21, so that the whole of the fitting confirmation member 24 is warped upward because of its own flexibility, as shown in FIG. 10B. As the housings approach to the completely-fitted position, the amount of engagement between the projections 25 of the fitting confirmation member 24 and the distal end portion 6*a*'' of the peripheral wall 6*a*', decreases gradually, and a lock pawl 4 of the lock arm 3 is abutted against the reverse surface of that portion of the fitting confirmation member 24 lying between the opposed projections 25.

Figure 10C:
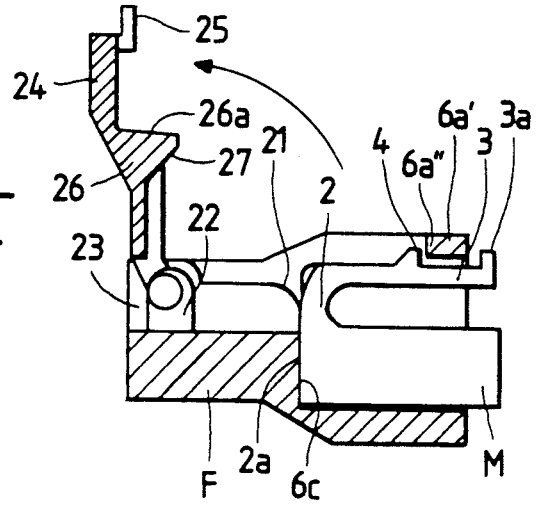

Then, when the female and male housings F and M are brought into the completely fitted condition as shown in FIG. 10C, the front end surface 2*a* of the male housing M is held against the rear end surface 6*c* of the sleeve portion, and the lock pawl 4 urges the reverse surface of the fitting confirmation member 24 upward to thereby release the engagement between the projections 25 and the distal end portion 6*a*'', so that the fitting confirmation member 24 is vigorously sprung out in a direction of an arrow by a repulsive force resulting from the restoration of the warping.

Thereafter, the fitting confirmation member 24 is pulled upward to be removed from the female housing F.

According to the first embodiment of the present invention, the fitting confirmation member 12, 24 is beforehand engaged in the retaining hole 8 before the fitting operation, and by doing so, the operator is positively prevented from forgetting the confirmation of the fitting. Further, after confirming the complete fitting, the fitting confirmation member is removed, and can be used again for another housing, and therefore the number of the component parts can be reduced.

As described above, in the present invention, if the female and male housings are incompletely fitted together, the fitting confirmation member is not projected, and this member is projected only in the completely fitted condition. Therefore, the incomplete fitting and/or incompletely locking can be positively prevented. Further, if the fitting confirmation member is merely engaged in the retaining hole, this positively prevents the operator from forgetting the confirmation of the fitting, and troubles resulting from the incomplete fitting can be prevented. Further, after confirming the complete fitting, the fitting confirmation member is removed and can be used again and again for other housings, and therefore the number of the component parts can be reduced, which is economical.

Figure 11:
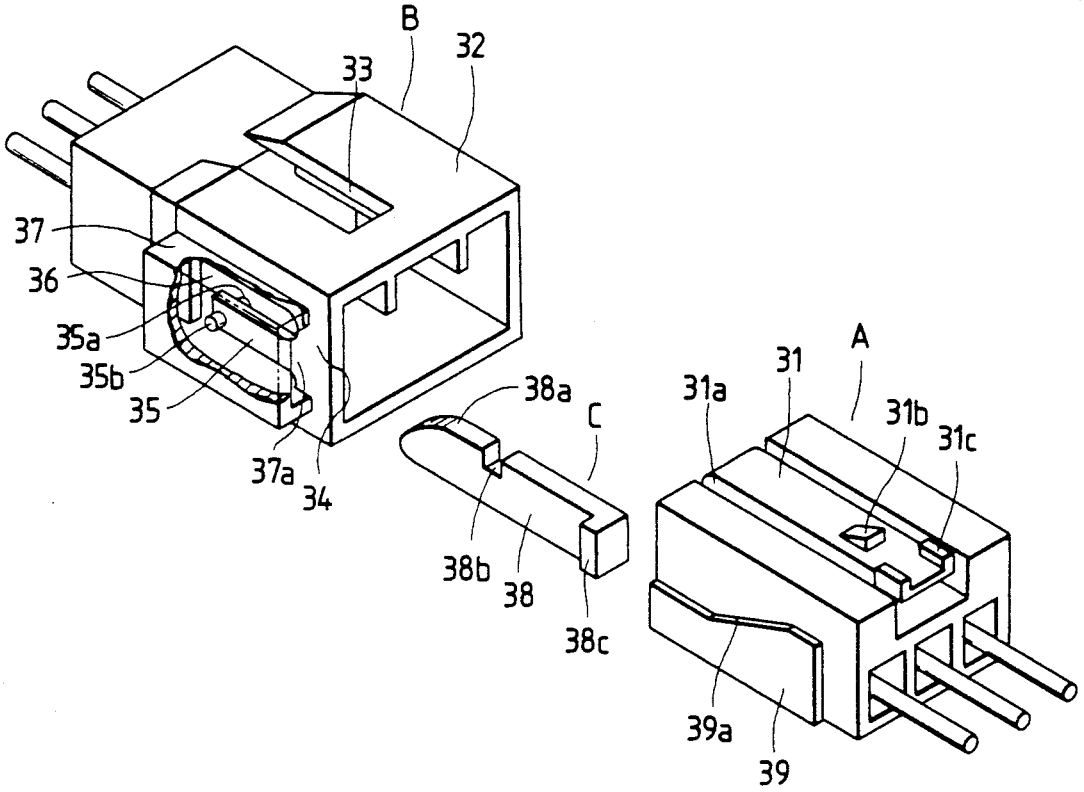
FIG. 11 is an exploded, perspective view of an incompletely fitting prevention connector according to a second embodiment of the present invention.

FIGS. 11, 12, 13A, 13B and 13C show an incomplete fitting prevention connector according to a second embodiment of the present invention. Referring to FIG. 11, a male connector housing A, a female connector housing B and a locking connection detection piece C are all made of a synthetic resin.

The male connector housing A has a flexible lock arm 31 extending rearwardly from an upstanding proximal portion 31*a* at a front end thereof. A locking projection 31*b* and an operating portion 31*c* are also formed on this male connector housing.

An engaging portion 33 for receiving the locking projection 31*c* is notched in a sleeve portion 32 of the female connector housing B.

A flexible retaining arm 35 of the cantilever type is formed on a side wall 34 of the sleeve portion 32 of the female connector housing B, and extends rearwardly. A driven projection 35*a* and a retaining projection 35*b* are formed respectively on the opposite sides of the free end of the flexible retaining arm 35, and thanks to the provision of a slit 36, the free end portion is displaceable upward and downward. A container case portion 37 is formed on the outer surface of the side wall 34, and has an opening 37*a* at its front end.

The locking connection detection piece C comprises a small piece of plate 38, and has a tapered drive portion 38*a* at its front end, and a retaining recess 38*b* in its upper surface, and an operating portion 38*c* at its rear end.

A projected portion 39 is formed on a side wall of the male connector housing A, and a tapered drive surface 39*a* is formed on the projected portion 39.

Figure 12:
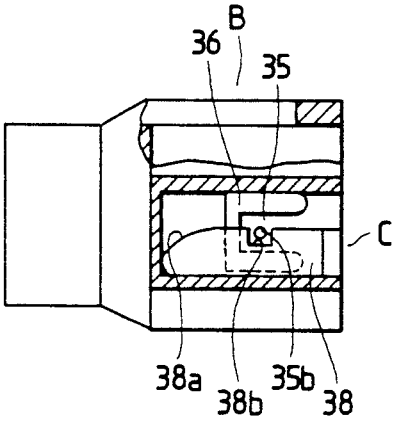
FIG. 12 is a partly-broken, side-elevational view of the connector in FIG. 11, showing a condition in which a locking connection detection piece is attached.

In the above construction, the locking connection detection piece C is beforehand inserted in the container case portion 37 of the female connector housing B, and at this time the retaining projection 35*b* on the free end of the flexible retaining arm 35 is displaced upward by the tapered drive portion 38*a*, and then is engaged in the retaining recess 38*b* to thereby prevent withdrawal of the locking connection detection piece C (FIG. 12).

Figure 13A:
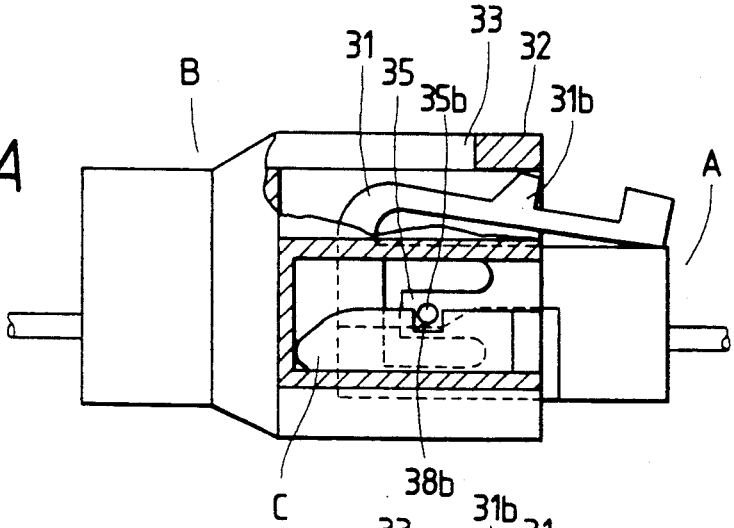
FIGS. 13A, 13B and 13C are partly-broken, side-elevational views of the connector in FIG. 11, showing the process of the fitting of a pair of connector housings.
Figure 13B:
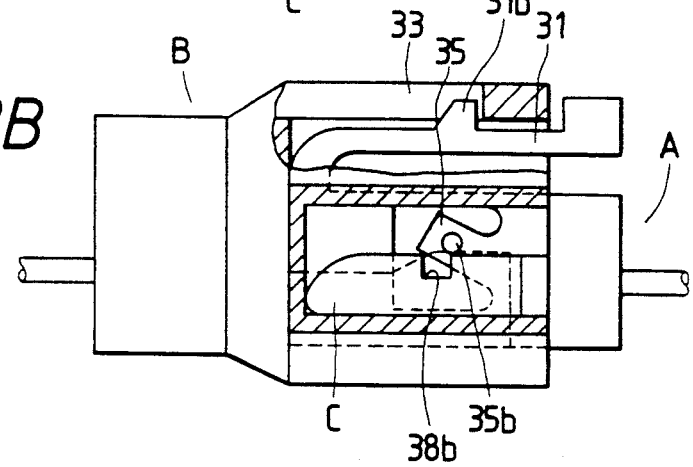
Figure 13C:
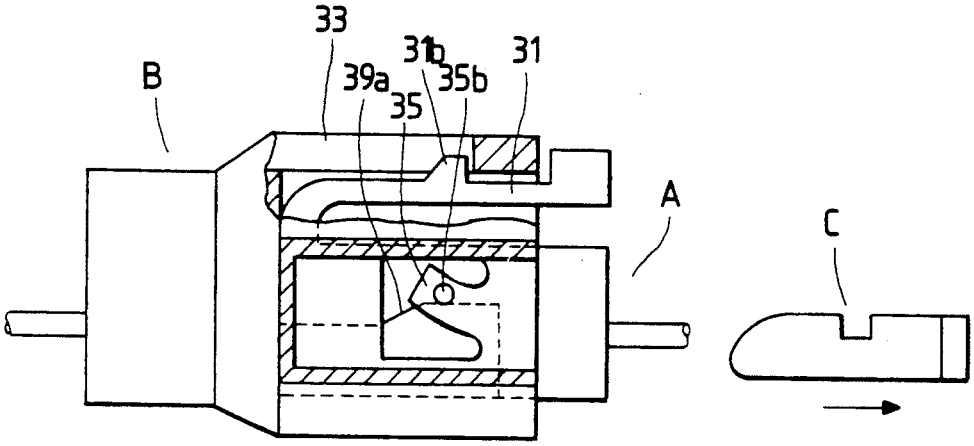

In this condition, when the connector housing A is to be fitted, the locking projection 31*b* of the flexible lock arm 31 is abutted against the front end of the sleeve portion 32, and then moves beneath the upper wall of the sleeve portion 32, so that the flexible lock arm 31 is displaced downward to thereby achieve an incompletely-connected condition (FIG. 13A). When this fitting further proceeds, the locking projection 31*b* is engaged in the engaging portion 33, so that the flexible lock arm 31 is fully restored to its initial condition to thereby achieve a completely-connected condition. At this time, the tapered drive surface 39*a* flexibly displaces the free end of the flexible retaining arm 35 upward through the driven projection 35*a*, so that the retaining projection 35*b* is disengaged from the retaining recess 38*b* of the locking connection detection piece C (FIG. 13B). Therefore, in this condition, the locking connection detection piece C can be withdrawn (FIG. 13C).

Figure 14:
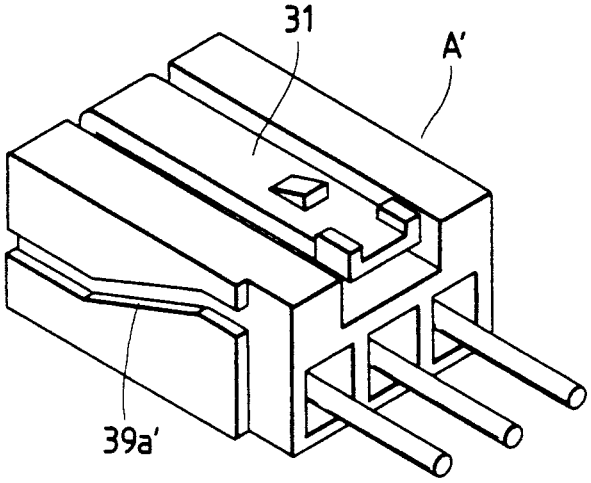
FIG. 14 is a perspective view of a modified form of one connector housing of the connector shown in FIG. 11.

FIG. 14 shows a modified one of the connector according to the second embodiment. In the connector shown in FIG. 14, instead of the tapered drive surface 39*a*, a tapered drive groove 39*a'* is formed in a side wall of a male connector housing A'.

Figure 15:
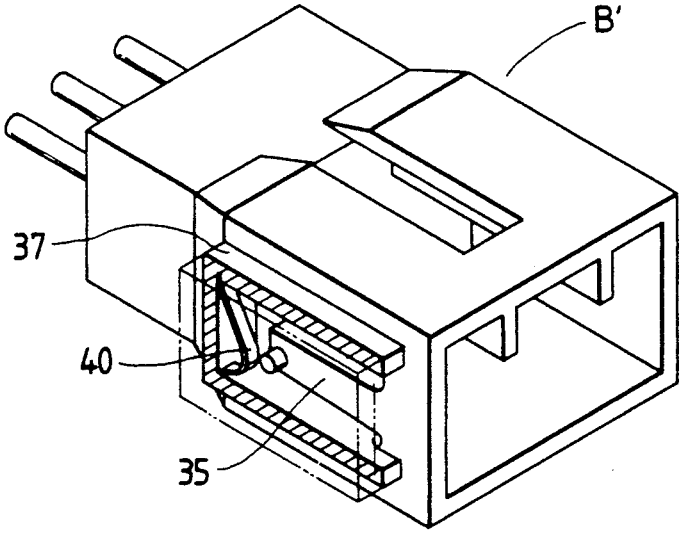
FIG. 15 is a partly-broken, perspective view of a modified form of the other connector housing of the connector shown in FIG. 11.

FIG. 15 shows another modified one of the connector according to the second embodiment. In the connector shown in FIG. 15, a resilient push piece 40 is provided at the inner end of a container case portion 37, and in the completely-connected condition, the resilient push piece 40 pushes a locking connection detection piece C outwardly.

As described above, the device according to the second embodiment of the present invention comprises the connector housing having the flexible lock arm; another connector housing having the engaging portion for engagement with the flexible lock arm; and the locking connection detection piece retained on one of the pair of connector housings by the flexible retaining piece. When the pair of connector housings are completely connected together, the other of the pair of connector housings drives the flexible retaining piece to release the retaining of the locking connection detection piece by the flexible retaining piece to thereby enable the removal of the locking connection detection piece. Therefore, the complete fitting of the connector can be detected easily and rapidly by withdrawing the locking connection detection piece.

What is claimed is:

1. A device for detecting a complete locking connection of a connector comprising:

a first connector housing having a flexible lock arm;

a second connector housing having an engaging portion for engagement with said flexible lock arm when said first and second connector housings are coupled to each other;

a flexible retaining piece provided on one of said first and second connector housings; and a locking connection detection piece retained on said one of said connector housings by said flexible retaining piece; wherein, when said connector housings are completely connected together, the other of said connector housings drives said flexible retaining piece to release the retaining of said locking connection detection piece by said flexible retaining piece to thereby enable the removal of said locking connection detection piece.

2. An incomplete fitting prevention connector, comprising:

a pair of first and second connector housings to be connected to each other;

first means for locking said connector housings to each other; and second means for confirming the locking by the first means, including:

a lock confirmation member;

engagement means for engaging said lock confirmation member with said first connector housing to retain said lock confirmation member on said first connector housing prior to connection of said connector housings; and releasing means for releasing the engagement between said lock confirmation member and said first connector housing when the connection between said connector housings is locked by said first means, to thereby enable the removal of said lock confirmation member to indicate the locking by the first means.

3. The incomplete fitting prevention connector according to claim 2, wherein said first and second connector housings are female and male connector housings, respectively, and said first means includes a lock arm having a fulcrum portion integrally formed on an upper surface of said male connector housing, an arm portion extending from said fulcrum substantially parallel to the upper surface of said male connector housing, and a lock pawl projected upwardly from said arm portion, and a retaining hole formed on said female connector housing for engagement with said lock pawl when said male connector housing is inserted into said female connector housing in place.

4. The incomplete fitting prevention connector according to claim 3, wherein said lock comfirmation member is retained in said retaining hole and engagement means includes at least one retaining projection formed on one of an inner peripheral surface of said retaining hole and an outer peripheral surface of said lock confirmation member, facing said inner peripheral surface of said retaining hole when said lock confirmation member is retained in said retaining hole, and at least one retaining portion corresponding to and being engageable with said retaining projection, formed in the other.

5. The incomplete fitting prevention connector according to claim 3, wherein said lock confirmation member is retained in said retaining hole, and engagement means includes two retaining projections formed on an inner peripheral surface of said retaining hole, two hinge holes formed in an outer peripheral surface of said lock confirmation member, facing said inner peripheral surface of said retaining hole when said lock confirmation member is retained in said retaining hole, and guide grooves extending from said hinge holes for guiding said retaining projections to said hinge holes.

6. The incomplete fitting connector according to claim 3, wherein said lock confirmation member is retained in said retaining hole, and engagement means includes at least one projection projected from said lock confirmation member and engaged with said female connector housing near said retaining hole.

7. The incompletely fitting connector according to claim 3, wherein said lock confirmation member is retained in said retaining hole, and further comprising:

pivot means for allowing a pivotable movement of said lock confirmation member relative to said retaining hole.

8. The incompletely fitting prevention connector according to claim 7, wherein said pivot means includes two retaining projections formed on an inner peripheral surface of said retaining hole and two hinge holes formed in an outer peripheral surface of said lock confirmation member, facing said inner peripheral surface of said retaining hole when said lock confirmation member is retained in said retaining hole.

9. The incompletely fitting prevention connector according to claim 7, wherein said pivot means includes two retaining projections formed on an inner peripheral surface of said retaining hole and two flexible wires extending from said lock confirmation member and having at distal ends thereof circular loops supported by said retaining projections.

10. The incomplete fitting prevention connector according to claim 7, wherein said pivot means includes a shaft formed on said lock confirmation member and means provided on an inner peripheral surface of said retaining hole for rotatably receiving said shaft.

11. The incompletely fitting prevention connector according to claim 10, wherein said pivot means includes triangular push portions projected from said lock confirmation member downwardly, having vertical front surfaces and inclined rear surfaces, respectively, and guide projections provided in said female connector and formed with rounded front ends for abutment with said inclined rear surfaces, respectively, and wherein said male connector, when inserted into said female connector, pushes said vertical front surfaces, thereby urging said lock confirmation member upwardly through said inclined rear surfaces and said rounded front ends.

12. The incompletely fitting prevention connector according to claim 6, wherein said releasing means is made up of said lock pawl urging said lock confirmation member retained in said retaining hole when said lock pawl is engaged with said retaining hole, thereby releasing the engagement between said lock confirmation member and said female connector.

13. The incompletely fitting prevention connector according to claim 12, wherein said releasing means includes a guide piece for guiding said lock pawl to an engagement position in said retaining hole during insertion of said male connector housing into said female connector housing, in said engagement position said claw being engaged with said retaining hole.

14. The incompletely fitting prevention connector according to claim 13, wherein said lock confirmation member includes a projecting portion projected into said engagement position in said retaining hole when said lock confirmation member is retained in said retaining hole, said lock confirmation member being urged through said projecting portion by said lock pawl when said lock pawl is engaged with said retaining hole.

15. The incompletely fitting prevention member according to claim 12, wherein said releasing means further includes triangular push portions projected from said lock confirmation member downwardly, having vertical front surfaces and inclined rear surfaces, respectively, and guide projections provided in said female connector and formed with rounded front ends for abutment with said inclined rear surfaces, respectively, and wherein said male connector, when inserted into said female connector, pushes said vertical front surfaces, thereby urging said lock confirmation member upwardly through said inclined rear surfaces and said rounded front ends.

16. The incomplete fitting prevention connector according to claim 3, wherein said female connector housing includes an opening formed on one side of said female connector housing, and a container case attached to the side of said female connector for defining in front of said opening a slit adapted for inserting said lock confirmation member into said container case.

17. The incomplete fitting prevention connector according to claim 16, wherein said engagement means includes a flexible retaining arm formed on the side of said female connector and projected to said opening, a retaining projection projected from said flexible retaining arm to said slit of said container case, and a retaining recess formed on said lock confirmation member for engagement with said retaining projection when said lock confirmation member is inserted into said container case in place.

18. The incomplete fitting prevention connector according to claim 17, wherein said releasing means includes a driven projection projected from said flexible arm to an interior of said female connector housing, and means for urging said flexible retaining arm through said driven projection to disengage said retaining projection from said retaining recess when said lock pawl is engaged with said retaining hole.

19. The incomplete fitting prevention connector according to claim 16, further comprising:

means for urging said lock confirmation member in a direction which is opposite to a direction in which said lock confirmation member is moved when inserted into said container case.

20. The incomplete fitting prevention connector according to claim 17, wherein said engagement means further includes a tapered guide surface formed on said lock confirmation member for guiding said retaining projection to said retaining recess during insertion of said lock confirmation member into said container case.

* * * * *